US006016575A

United States Patent [19]

Prychak

[11] Patent Number: 6,016,575

[45] Date of Patent: Jan. 25, 2000

[54] DRY SOCK SYSTEM

[76] Inventor: Tim E. Prychak, P.O. Box 14 RAMA, Saskatchewan, Canada, S0A 3H0

[21] Appl. No.: 09/263,549

[22] Filed: Mar. 8, 1999

[51] Int. Cl.[7] ..... A41B 11/00

[52] U.S. Cl. ..... 2/239; 2/409

[58] Field of Search ..... 2/239, 409; 66/171, 66/178 R, 178 A, 183–187, 196, 201

[56] References Cited

U.S. PATENT DOCUMENTS

| | | | |
|---|---|---|---|
| 3,128,763 | 4/1964 | Langenfeld et al. | 2/239 |
| 4,631,755 | 12/1986 | Zingg et al. | 2/239 |
| 4,651,354 | 3/1987 | Petrey | 2/239 |
| 4,898,007 | 2/1990 | Dahlgren | 66/185 |
| 5,095,548 | 3/1992 | Chesebro, Jr. | 2/239 |

*Primary Examiner*—Gloria M. Hale

[57] ABSTRACT

A dry sock system including an intermediate foot portion in a generally tubular configuration positioned circumferentially around the majority of a wearer's foot having an open upper end positioned at the lower portion of the wearer's ankle and a lower end positioned in proximity to the wearer's toes, the intermediate portion being formed of an absorbent material. The dry sock system also includes an upper portion formed of elastomeric material with widely spaced vertical ribs from the upper portion of a wearer's ankle to the lower portion of the wearer's ankle and coupled to the instep region and the heel region. Individual toe portions of varying size are provided in the system including a large portion positioned around the wearer's big toe and a smallest portion positioned around the wearer's little toe with three intermediate portions of varying sizes, the toe portions having individual closed exterior ends and open interior ends.

3 Claims, 1 Drawing Sheet

DRY SOCK SYSTEM

BACKGROUND OF THE INVENTION

1. Field of the Invention

The present invention relates to a new and improved dry sock system and, more particularly, pertains to reducing discomfort from excess foot perspiration.

2. Description of the Prior Art

The use of apparel for the foot of known designs and configurations is known in the prior art. More specifically, apparel for the foot of known designs and configurations heretofore devised and utilized for the purpose of increasing the comfort of a wearer's foot through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of apparel for the foot of known designs and configurations. By way of example, U.S. Pat. No. Des. 331,830 to Unvergerth discloses a Toe Sock.

U.S. Pat. No. 4,037,436 to Wehrmann discloses a Toe Construction and Method For Seamless Hosiery Products.

U.S. Pat. No. 3,967,390 to Anfruns discloses a Shoe.

U.S. Pat. No. Des. 126,528 to Greenwald discloses a Stock or Similar Article.

Lastly, International Application Number PCT/US93/05600 to Dahlgren discloses Footwear for Facilitating The Removal and Dissipation of Perspiration.

In this respect, the dry sock system according to the present invention substantially departs from the conventional concepts and designs of the prior art, and in doing so provides an apparatus primarily developed for the purpose of reducing discomfort from excess foot perspiration.

Therefore, it can be appreciated that there exists a continuing need for a new and improved dry sock system which can be used for reducing discomfort from excess foot perspiration. In this regard, the present invention substantially fulfills this need.

SUMMARY OF THE INVENTION

In view of the foregoing disadvantages inherent in the known types of apparel for the foot of known designs and configurations now present in the prior art, the present invention provides a new and improved dry sock system. As such, the general purpose of the present invention, which will be described subsequently in greater detail, is to provide a new and improved dry sock system and methods which have all the advantages of the prior art and none of the disadvantages.

To attain this, the present invention essentially comprises a new and improved dry sock system. The system is designed for the purpose of reducing discomfort from excess foot perspiration and comprises in combination an intermediate portion. The intermediate portion is in a generally tubular configuration positioned circumferentially around the majority of a wearer's foot and has an open upper end positioned at the lower portion of the wearer's ankle and a lower end positioned in proximity to the wearer's toes. The intermediate portion is formed of an absorbent material with generally horizontal ribs along its upper extents and forward in the instep region and with generally vertical ribs along its lower and rearward portion in the heel region. The dry sock system of the present invention further includes an upper portion. The upper portion is formed of elastomeric material with widely spaced vertical ribs from the upper portion of a wearer's ankle to the lower portion of the wearer's ankle and coupled thereat to the instep region at the heel region. Also provided in the dry sock system of the present invention is an elastic band positioned circumferentially around the upper extent of the upper portion for maintaining the socks in proper orientation upon a wearer's foot and ankle. Lastly provided in the dry sock system of the present invention are individual toe portions of varying size including a large portion positioned around the wearer's big toe and a smallest portion positioned around the wearer's little toe with three intermediate portions of varying sizes. The toe portions have individual closed exterior ends and open interior ends integrally formed with a common circumferential region coupled to the lower region of the intermediate portion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved dry sock system which has all the advantages of the prior art apparel for the foot of known designs and configurations and none of the disadvantages.

It is another object of the present invention to provide a new and improved dry sock system which may be easily and efficiently manufactured and marketed.

It is a further object of the present invention to provide a new and improved dry sock system which is of a durable and reliable construction.

An even further object of the present invention is to provide a new and improved dry sock system which is susceptible of a low cost of manufacture with regard to both materials and labor, and which accordingly is then susceptible of low prices of sale to the consuming public, thereby making such a dry sock system economically available to the buying public.

Even still another object of the present invention is to reducing discomfort from excess foot perspiration.

Lastly, it is an object of the present invention to provide a dry sock system including an intermediate foot portion in a generally tubular configuration positioned circumferentially around the majority of a wearer's foot having an open upper end positioned at the lower portion of the wearer's ankle and a lower end positioned in proximity to the wearer's toes, the intermediate portion being formed of an absorbent material. The dry sock system also includes an upper portion formed of elastomeric material with widely spaced vertical ribs from the upper portion of a wearer's ankle to the lower portion of the wearer's ankle and coupled to the instep region and the heel region. Individual toe portions of varying size are provided in the system including a large portion positioned around the wearer's big toe and a smallest portion positioned around the wearer's little toe with three intermediate portions of varying sizes, the toe portions having individual closed exterior ends and open interior ends.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
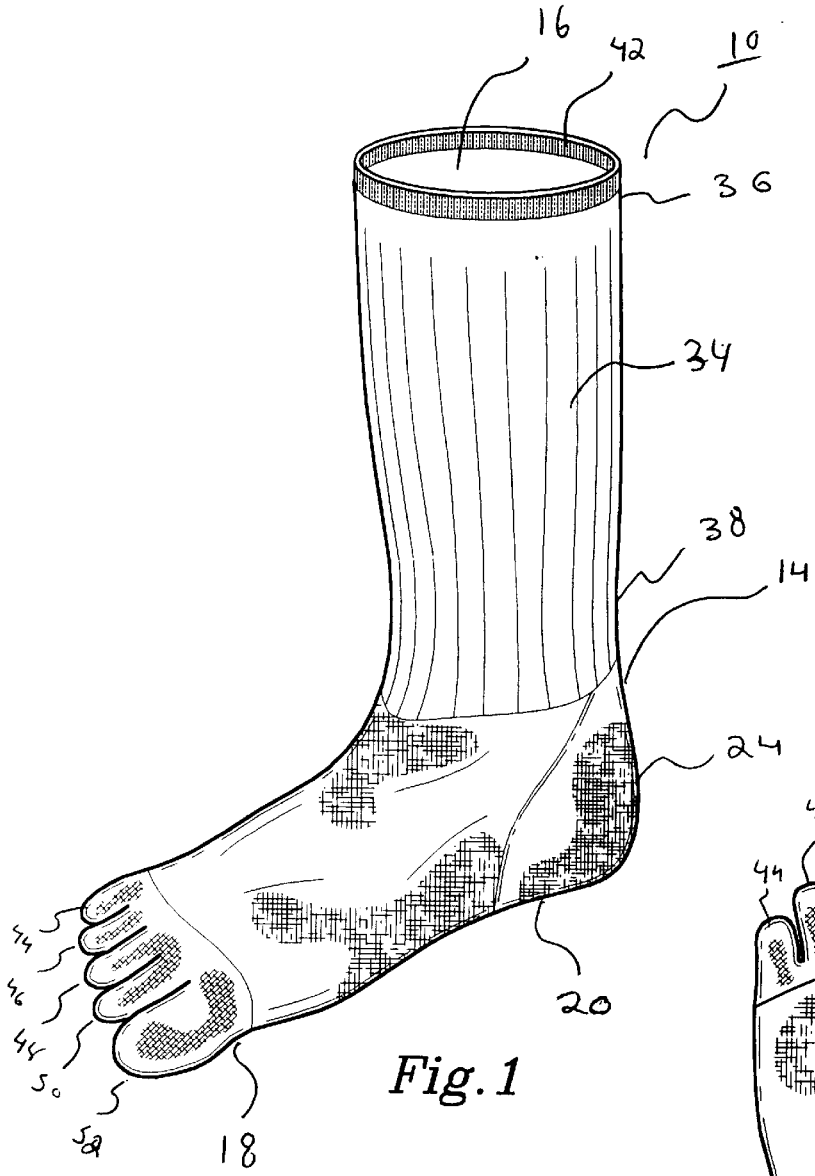
FIG. 1 is a perspective illustration of the preferred embodiment of the dry sock system constructed in accordance with the principles of the present invention.
Figure 2:
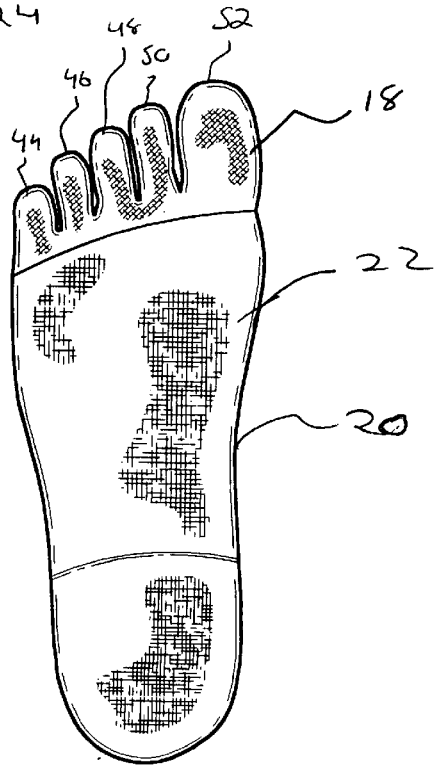
FIG. 2 is a bottom elevational view of the sock shown in FIG. 1.

With reference now to the drawings, and in particular to FIGS. 1 through 2 thereof, the preferred embodiment of the new and improved dry sock system embodying the principles and concepts of the present invention and generally designated by the reference numeral 10 will be described.

The present invention, the new and improved dry sock system, is a system 10 comprised of a plurality of components. Such components, in their broadest context, include an intermediate foot portion, an upper portion, an elastic band and toe portions. Each of the individual components is specifically configured and correlated one with respect to the other so as to attain the desired objectives.

The present invention as described herein is a new and improved dry sock system 10. The system is designed for the purpose of reducing discomfort from excess foot perspiration and comprises in combination an intermediate portion 14. The intermediate portion is in a generally tubular configuration positioned circumferentially around the majority of a wearer's foot and has an open upper end 16 positioned at the lower portion of the wearer's ankle and a lower end 18 positioned in proximity to the wearer's toes. The intermediate portion is formed of an absorbent material with generally horizontal ribs 20 along its upper extents and forward in the instep region 22 and with generally vertical ribs 24 along its lower and rearward portion in the heel region.

The dry sock system of the present invention further includes an upper portion 32. The upper portion is formed of elastomeric material with widely spaced vertical ribs 34 from the upper portion 36 of a wearer's ankle to the lower portion 38 of the wearer's ankle and coupled thereat to the instep region at the heel region.

Also provided in the dry sock system of the present invention is an elastic band 42 positioned circumferentially around the upper extent of the upper portion for maintaining the socks in proper orientation upon a wearer's foot and ankle.

Lastly provided in the dry sock system of the present invention are individual toe portions 44, 46, 48, 50 and 52 of varying size including a large portion positioned around the wearer's big toe and a smallest portion positioned around the wearer's little toe with three intermediate portions of varying sizes. The toe portions have individual closed exterior ends and open interior ends integrally formed with a common circumferential region coupled to the lower region of the intermediate portion.

The dry sock system of the present invention is a specially designed sock for the purpose of reducing discomfort from excess foot perspiration. The sock system of the present invention features separately formed toes, like gloves for the foot. The fabric between the toes is intended to help absorb perspiration, as well as to provide for extra ventilation between the toes to dry away perspiration. The system of the present invention can be fabricated from an absorbent material such as cotton, with stretchable fiber or weave incorporated into the toe sleeves to keep the fabric close and comfortable to the toes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dry sock system designed for the purpose of reducing discomfort from excess foot perspiration comprising, in combination:

an intermediate portion in a generally tubular configuration positioned circumferentially around the majority of a wearer's foot having an open upper end positioned at the lower portion of the wearer's ankle and a lower end positioned in proximity to the wearer's toes, the intermediate portion being formed of an absorbent material with generally horizontal ribs along its upper extents and forward in the instep region and having generally vertical ribs along its lower and rearward portion in the heel region;

an upper portion formed of elastomeric material with widely spaced vertical ribs from the upper portion of a wearer's ankle to the lower portion of the wearer's ankle and coupled thereat to the instep region at the heel region;

an elastic band positioned circumferentially around the upper extent of the upper portion for maintaining the socks in proper orientation upon a wearer's foot and ankle; and individual toe portions of varying size including a large portion positioned around the wearer's big toe and a smallest portion positioned around the wearer's little toe with three intermediate portions of varying sizes, the toe portions having individual closed exterior ends and open interior ends integrally formed with a common circumferential region coupled to the lower region of the intermediate portion.

2. A dry sock system comprising:

an intermediate foot portion in a generally tubular configuration positioned circumferentially around the majority of a wearer's foot having an open upper end positioned at the lower portion of the wearer's ankle and a lower end positioned in proximity to the wearer's toes, the intermediate portion being formed of an absorbent material;

an upper portion formed of elastomeric material with widely spaced vertical ribs from the upper portion of a wearer's ankle to the lower portion of the wearer's ankle and coupled to the instep region and the heel region; and individual toe portions of varying size including a large portion positioned around the wearer's big toe and a smallest portion positioned around the wearer's little toe with three intermediate portions of varying sizes, the toe portions having individual closed exterior ends and open interior ends.

3. The system as set forth in claim 2 and further including an elastic band around the upper end of the upper portion.

* * * * *